US005806847A

United States Patent [19]

White et al.

[11] Patent Number: 5,806,847

[45] Date of Patent: Sep. 15, 1998

[54] WAGERING GAME EMPLOYING DICE

[76] Inventors: Roger L. White, 3357 Zephyr Ct., Las Vegas, Nev. 89121; John A. Bell, 4012 Alameda Ave., Las Vegas, Nev. 89110

[21] Appl. No.: 891,017

[22] Filed: Jul. 10, 1997

Related U.S. Application Data

[63] Continuation of Ser. No. 790,383, Jan. 29, 1997, abandoned, which is a continuation of Ser. No. 653,828, May 28, 1996, abandoned, which is a continuation of Ser. No. 167,536, Dec. 14, 1993, abandoned.

[51] Int. Cl.[6] ..... A63F 9/04

[52] U.S. Cl. ..... 273/309; 273/146; 273/274

[58] Field of Search ..... 273/148 R, 309, 273/292, 294, 274, 146

[56] References Cited

U.S. PATENT DOCUMENTS

| | | | |
|---|---|---|---|
| D. 263,975 | 4/1982 | Quiroga et al. | 273/309 X |
| 672,354 | 4/1901 | Comstock | 273/309 |
| 3,399,897 | 9/1968 | Mitchell | 273/146 |
| 4,346,900 | 8/1982 | Lamlee | 273/146 X |
| 4,635,938 | 1/1987 | Gray | 273/146 X |
| 4,688,803 | 8/1987 | Ollington | 273/274 |
| 4,743,031 | 5/1988 | Lamle | 273/146 |
| 4,900,034 | 2/1990 | Bereuter | 273/146 |
| 4,989,874 | 2/1991 | Freitas | 273/146 |
| 5,078,404 | 1/1992 | Barillaro et al. | 273/309 X |
| 5,228,698 | 7/1993 | Dubarry, Jr. | 273/274 X |
| 5,265,881 | 11/1993 | Doherty | 273/146 X |
| 5,308,081 | 5/1994 | Bartle | 273/274 |

*Primary Examiner*—William E. Stoll
*Attorney, Agent, or Firm*—Terrance L. Siemens

[57] ABSTRACT

A game of chance having a playing surface including a plurality of betting areas. The betting areas have a plurality of betting squares for wagering upon a selected result produced by a random result selector such as dice. In one embodiment, the random result selector comprises a plurality of dice having a plurality of faces, each face embossed with either a number or a special symbol. Each betting square contains result indicators that correspond to a selected one of the plurality of results. In addition, each betting square contains payoff indicator that indicates the payoff associated with a winning wager on the selected betting square. A single random result leads to a final and unequivocal outcome of all bets made on all betting squares. The playing surface is adapted to be placed over existing casino equipment, or may be used alone.

10 Claims, 2 Drawing Sheets

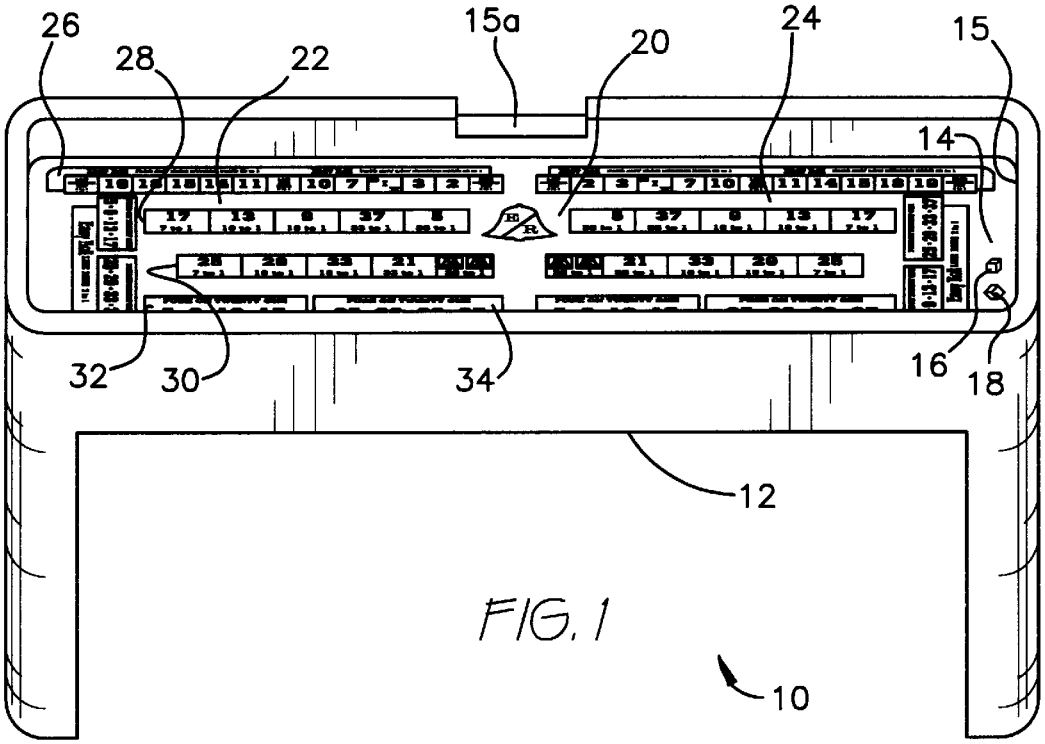
FIG. 1
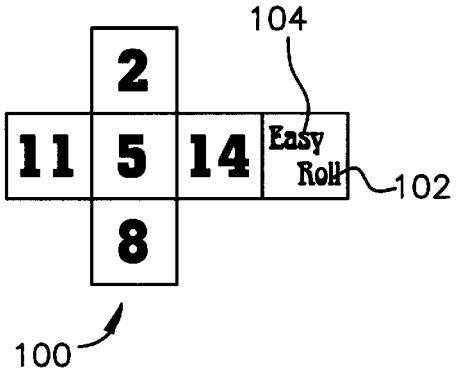
FIG. 3
FIG. 4
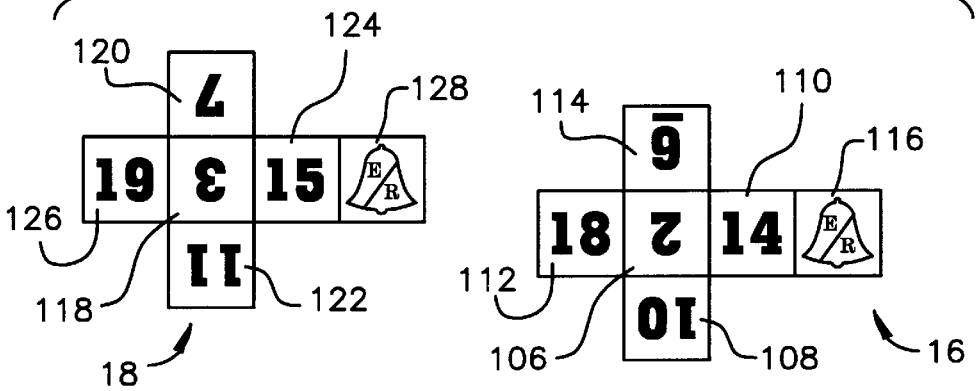

WAGERING GAME EMPLOYING DICE

CROSS REFERENCE TO RELATED APPLICATIONS

This application is a continuation of application Ser. No. 08/790,383 filed Jan. 29, 1997, now abandoned, which is a continuation of application Ser. No. 08/653,828 filed May 28, 1996, now abandoned, which is a continuation of application Ser. No. 08/167,536 filed Dec. 14, 1993, now abandoned.

BACKGROUND OF THE INVENTION

1. Field of the Invention

The present invention relates to casino games, and more particularly, but not by way of limitation, to a wagering game employing dice that is intended to be played in gambling casinos, but which game can also be played in non-gambling settings. Even more particularly, the instant invention is intended to give the look and feel of the currently popular game of craps, yet have simplified rules and procedures designed both to encourage use by novice gamblers and to increase the betting decisions per hour to maximize casino profit.

2. Description of the Prior Art

Virtually all casinos, especially those in the gaming capitals of the world, have board games that are played for gambling purposes. The oldest and most popular board games involve the use of dice to determine the outcome of wagers. Of these games, the most popular and well known is the game of craps. Craps has the reputation of being one of the fastest and most exciting table games offered by casinos. However, the game of craps presents various betting schemes that appear complicated to the uninitiated and the speed of play intimidates the beginner. As a result craps has a reputation of being difficult to learn and play. As a result, although craps is generally perceived to be exciting and attractive, many casino patrons are intimidated and discouraged from playing. This results in lost business for the casinos, and less gaming diversity for the gambling public.

As an example of the complexity presented by the prior art gaming table games employing dice, a brief summary of the wagering and playing rules of craps follows. Craps revolves around the player who handles the dice, referred to as the "shooter." All players at the table essentially wager either with or against the shooter. That is, every player at the craps table wagers whether the shooter will "make a pass" and win the game or fail to make a pass and thereby lose control of the dice to the next shooter.

The game of craps is initiated when a new shooter is first given the dice to throw what is referred to as the "come-out" roll. However, to be eligible to throw the "come-out" roll, the shooter must wager some money or the equivalent, usually the house minimum wager, on either the "pass" or "don't pass" field located on the craps table. There are, of course, many other wagers that are possible in addition to this one, but this initial wager must be made before the shooter may roll the dice. The other players at the table have unrestricted wagers available to them. There are many "side" bets that can be placed, each having different odds of success and rates of return. Disadvantageously, there are no markings on the craps table to indicate either the odds of success or the return on investment for any particular wager. As a result, only experienced players comprehend the risks involved in placing these side bets and, consequently, most casual players do not partake of this form of wagering.

The object of craps is for the shooter to make a pass and continue throwing the dice. There are two identical cubical six-sided die used in craps. Referred to collectively they are referred to as the dice. Both die have dimples or dots embossed on their six sides. Each separate side thus represents a number corresponding to the number of dimples on that side. Each separate side of a single die is dimpled to represent a unique single number from one to six. Two dice are simultaneously rolled by a shooter which must come to rest with an upper face corresponding to an integer number from through six. Thus the sum of the two upward faces must be an integer number from 2 through 12. The laws of probability dictate the chances of obtaining any one particular sum. The least likely sums are a 2 or a 12 with the most likely sum being a 7.

After placing a wager on either the "pass line" or the "don't pass line", the shooter rolls the dice onto the craps table. If the total of the dice rolled is equal to either 7 or 11, the shooter has passed; i.e., the "pass" line wagers win and the "don't pass" line wagers lose. If the shooter rolls a "craps"—a total of either 2, 3, or 12—the "pass" line wagers lose and the "don't pass" line wagers win.

If any other total results from the come-out roll, a 4, 5, 6, 8, 9, or 10, the shooter has established what is referred to as the "point." Once the point is established, the house dealer places a white marker on a space on the table bearing the number corresponding to the point. If the shooter repeats the point before rolling a 7, the shooter once again "passes"—the pass line wagers win and the don't pass wagers lose. However, if the shooter rolls a 7 prior to repeating a roll of the point, the shooter does not pass, or "sevens-out", and the pass line wagers lose while the don't pass line wagers win. After a shooter "sevens-out", the dice are transferred to the next player, and the next player becomes the new shooter.

Once a point is established, only a roll totaling that point, or a roll totaling "seven," will determine whether a pass line bet is won or, in the case of a "seven" roll, lost. All other numbers thrown in the interim affect only the success or failure of "side bets." Players may make side bets anytime during the play of the game. There are several areas on the craps table that are designated for side bets. For example, a side bet may be placed on either of the numbers 6 or 8 by placing money in the area designated for that wager. A 6 or 8 place bet is successful if the 6 or 8 is rolled, prior to the rolling of a 7. The 6 or 8 bet loses when a 7 is rolled, except on the come-out roll.

The 6 and 8 place bet return a payoff of 7 to 6. Place bets made on the 5 and 9 return a payoff of 7 to 5, and place bets on the 4 and 10 return a payoff of 9 to 5. The payoffs are apportioned to adequately reward players who have risk a wager on a given number but yet not quite adequately compensate them in proportion to the risk the have taken. The difference is the house take. Since there is a house take on every bet made it is clear that for the house to maximize its profits it should maximize the number of bets decided per unit time.

Disadvantageously, the craps table playing surface does not indicate the availability, the payoffs, or the duration of the side bets. Different side bets are in effect for different periods of time. Some are effective for one roll only; others remain in effect until the shooter either "sevens-out" or makes the point. Nowhere on the craps table is there an indication of the duration of a side bet. Consequently, even experienced craps players often hesitate before placing such wagers, resulting in lost betting opportunities for them, and lost revenue for the casino. Novice craps players are even more hesitant to place wagers. Additionally, because payoffs are not indicated on the table, only experienced craps players are able to appreciate the risks involved in making these wagers. However, the great number of possible bets causes even experienced players to occasionally forget the odds and payoffs associated with one or more particular wagers, which in turn results in slow play and disruption to the flow of the game. For example, because the odds are not indicated on the craps table, players must often ask what the payoff is on a particular side bet. This results in less wagering decisions per hour for the casino, less revenue, and ultimately, diminished enjoyment for the players.

Due to the complexity involved in playing the popular wagering games employing dice, as exemplified by the brief summary of craps given above, there is a need for a simpler game of chance that will appease all strata of expertise in the art of gambling, yet remain challenging and enjoyable. Although craps is a popular table game, there are relatively few wagering options, and even these few options are not intuitively obvious nor readily apparent to the casual observer. Furthermore, the shooter rolls the dice until he or she "seven's out," and therefore, the dice are not passed from player to player in rapid succession. Moreover, the payoffs and odds of success are not generally known to the betting public, not easily discernable from observing the game, and gambling is thereby discouraged. The pace at which craps is played is intimidating, leaving little opportunity for the novice player to acquire knowledge of the game. Consequently, the number of players who play craps has declined over the years, and is likely to so continue.

Another extremely popular game currently found in most casinos is the game of roulette, the rules of which are widely published. This game provides more betting options than does craps, but the game involves somewhat complicated hardware. This increases the complexity of the game and associated operational overhead. The great advantage with roulette, which leads to its popularity, is its simplicity and accessibility to the ever-increasing numbers of novice gamblers. For example, players can wager on individual numbers, which payoff at very high odds, or on black or red, or even or odd results. In addition to the easily understood rules and betting options, roulette offers tremendous betting advantages to the casino, which ultimately results in more casino revenue.

Moreover, the number of wagers decided per hour, or "decisions per hour", is much higher in roulette than in craps. For example, in craps, because the time to either make a point or seven-out is indefinite, it may take several minutes to determine the outcome of a particular pass line wager. In contrast, a wager in roulette is decided on every turn of the roulette wheel. Consequently, roulette yields more money to the casino over a shorter period of time.

Disadvantageously, roulette does not allow players to fully participate in the game. In most casinos, particularly those found in the gaming capitols of the world, the ball and wheel are handled only by dealers and others who represent the casino. One of the most appealing and desirable features of any gaming activity is the ability for a member of the betting public to directly participate in determining the outcome of wagers. Craps, for example, has been noted as being especially enjoyable because the players are allowed to handle the dice and ultimately determine the outcome of the wagers. Similarly, slot machines are popular largely because the player is allowed to handle the equipment that determines the success or failure of her wager. Even if other factors are involved, it is advantageous to increase the perception that the player has an influence on the outcome of the game.

Therefore, despite the popularity of both craps and roulette, these games present several disadvantages to the casinos and players alike. Although there have been attempts to improve upon existing games and to develop new games of chance, none of the prior art games have been able to overcome the disadvantages described hereinabove. A need exists for a wagering game employing dice or their electronic equivalent that is intended to be played in gambling casinos, that is simple to learn and play, and that results in more wagering decisions per hour and increased revenues for the casino.

U.S. Pat. No. 5,228,698, issued to A. P. Dubarry, Jr. on Jul. 20, 1993 discloses a board game with printing thereon which uses dice from time to time. Wagers or bets may be required depending on the outcome of the dice roll. By contrast, the game of the instant invention requires at least one wager prior to the roll of the dice and requires that the outcome of that wager be fully determined by the single roll of the dice.

U.S. Design Pat. No. 263,975, issued to John S. Quiroga, et al. on Apr. 20, 1982, discloses an ornamental design for a gaming table. By contrast the instant invention is not directed to any sort of ornamental appearance of a game table although playing considerations dictate certain broad geometric relationships between the various play areas on the table. In addition the required geometric relationships of the instant invention, a craps-type dice game, are far removed in appearance and function from the black-jack-type table of Ouiroga, et al.

U.S. Pat. No. 5,308,081, issued to Richard J. E. Bartle on May 3, 1994, discloses a three dice betting game with a game board having various betting areas corresponding to various dice roll outcomes. Payoffs for various outcomes are printed on the playing surface of Bartle. However, the disclosed method of playing the Bartle game makes it abundantly clear that multiple rolls of the dice are required to determine the outcome of the wagers. By contrast, the instant invention is arranged such that the outcome of all wagers is fully an finally decided after each and every roll of the dice.

None of the above prior art games, inventions and patents, taken singly or in any combination, is seen to describe the instant invention as claimed.

SUMMARY OF THE INVENTION

The present invention solves the problems presented in the prior art by providing an apparatus for playing a game of chance, the apparatus comprising: a pair of dice, each die marked on five of its six faces with a different number and on its sixth face with a special symbol; and a playing surface marked with a plurality of spaces to accommodate money, casino chips, or the like, and a marker to indicate the results of the last roll of the dice. In a variant of the invention electronic dice may be used instead of the physical cubes generally referred to as dice. Electronic dice are understood to be dual random number generators that each randomly display with equal likelihood one of six possible outcomes. Thus the dual displays represent a realistic simulation of actually rolling cubical dice. Throughout the remainder of this disclosure the term dice shall be taken to mean either physical or electronic dice.

The present dice game, while exhibiting many valuable gaming features, as explained below in more detail, also can be inexpensively manufactured and incurs minimal operational overhead expenses. While the present invention may, in one embodiment, comprise a separate, approximately five-foot by eight-foot rectangular table, the present playing surface may be formed as a thin overlay to be placed atop existing casino game table equipment such as craps tables.

In addition, if there are an insufficient number of players to warrant operating a full table, the table may be split in half, with one half of the table unoccupied, and the other half utilized for playing the game. Advantageously, the operational expenses associated with the present game are low. To operate the present game, the casino need only employ one or two dealers.

The game has a minimal number of rules, and the rules are readily apparent to the novice gambler after very little observation. The present game is preferably played with two dice, the first die preferably having even numbers imprinted on five of its six faces, and on its sixth face are imprinted either words or a specialized symbol or logo. The Numeric value associated with the sixth face is a null or zero. The second die has odd numbers imprinted on five of its six faces, and its sixth face is imprinted identically with the sixth face of the first die.

Each player has an opportunity to roll the dice on a rotating basis. In the case of electronic dice an actuating button or similar device would be made accessible to each player on a rotating basis. In one preferred embodiment, if the "rolling player," or "shooter," wins his or her bet, the shooter continues to roll the dice. Otherwise, the dice are passed to the next player. In an alternative embodiment, there is a new shooter after each and every roll of the dice. Therefore, the present game advantageously increases the number of players directly involved in the ultimate outcome of the game, and thereby increases player participation and satisfaction.

The playing surface is divided into a plurality of discrete areas that are used for different wagering purposes. In one preferred embodiment, the table layout makes available twenty-five different wagering spaces or combinations. A player wagers on the outcome of any selected roll of the dice by placing a wager in a space dedicated for the selected wager. The spaces or betting areas on the table correspond to all possible results or combinations of the two dice. The player wins the wager if the combination of the two symbols shown on the dice corresponds to the combination upon which the player wagered. Additionally, in the preferred embodiment, the individual combinations may be combined into other wagers, referred to as "field" or "line" wagers. If the player places a field or line wager, the player wins the wager if the two symbols shown on the dice after the roll correspond to any of the several dice combinations covered by the field wager.

In the preferred embodiment, the playing surface also indicates the payoffs or returns on investment for each possible roll combination. Therefore, each time that a player places a wager, the player may easily determine what the return will be if the wager is successful. No a priori knowledge of the odds or payoffs is necessary for the player to be able to determine the return on his investment. This provides a significant advantage over the prior art games of chance employing dice.

In the preferred embodiment of the present game of chance, every wager is effective for only one roll of the dice. In contrast to the prior art games, such as craps, the present game produces more wagering decisions, successes or failures, per hour. This results in more overall revenue for the casino. Moreover, the present invention yields a higher advantage to the casino than do the prior art games. Thus the present invention represents a substantial improvement over casino games of the prior art because it simplifies play and encourages wagering, which in turn leads to increased entertainment and increased revenue for the casino.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein:

FIG. 1 is a perspective view showing a gaming table constructed in accordance with the principles of the present invention;

FIG. 3 schematically shows a development of a die for use with a surface marked as shown in FIG. 1; and FIG. 4 schematically shows a development of dice for use with a surface marked as shown in FIG. 1.

DETAILED DESCRIPTION OF THE PREFERRED EMBODIMENTS

Figure 2:
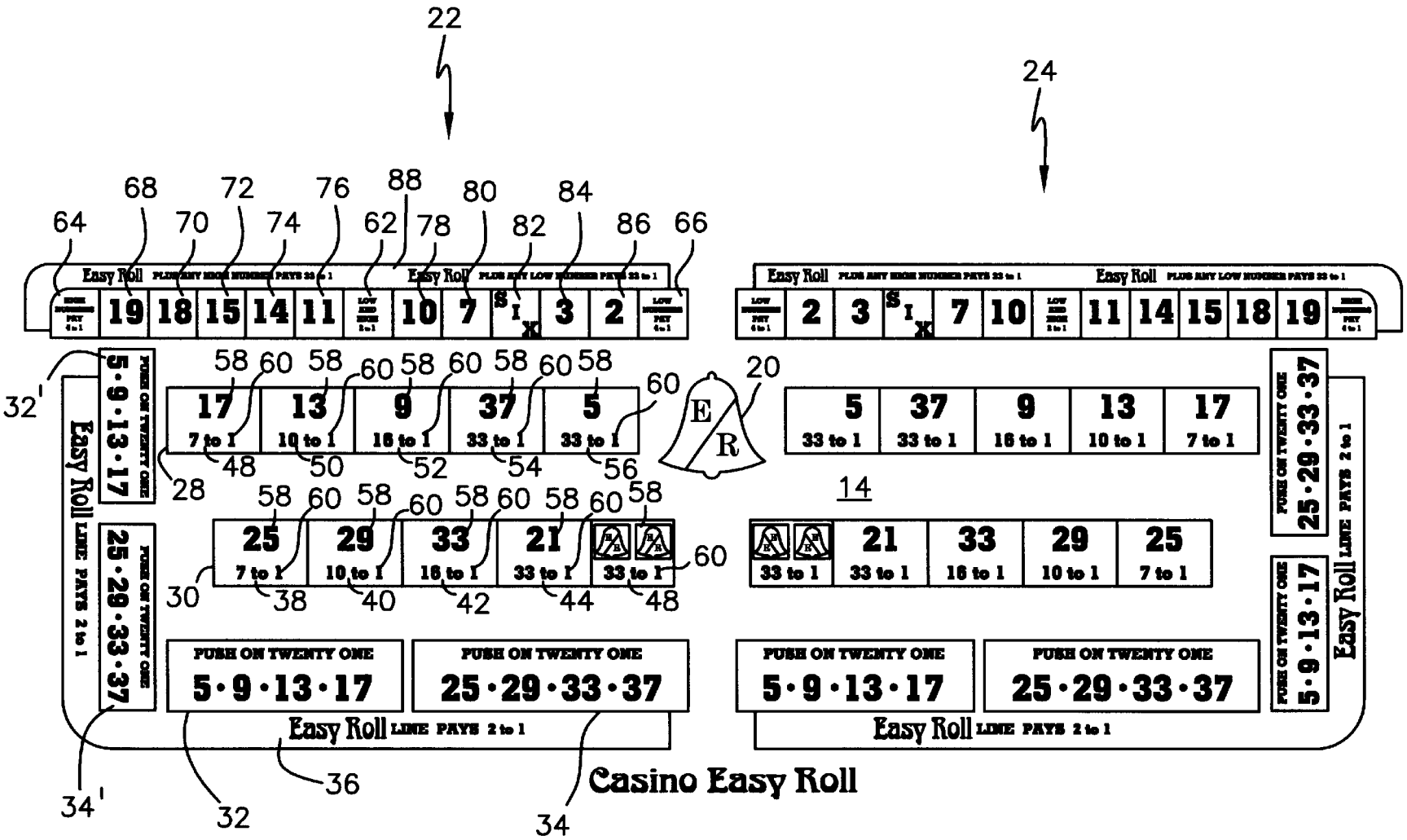
FIG. 2 is a diagrammatic plan view of the playing surface used in the gaming table of FIG. 1.

Reference is now made to the drawings wherein like numerals refer to like parts throughout. Referring to FIG. 1, there is shown a gaming table constructed in accordance with the principles of the present invention and designated generally as 10. In one preferred embodiment, the gaming table game 10 includes a substantially rectangular-shaped board 12 having an upper playing surface 14 thereon. In one embodiment, the board 12 is approximately five feet wide by eight feet long. In an alternative embodiment, the playing surface 14 may be laid over an existing casino gaming table, typically a gaming table for playing a game of craps. Thus, the present game can easily be adapted for use on existing casino equipment. There are, therefore, few operational expenses in converting existing casino equipment for use with the present invention.

In the preferred embodiment, the gaming table 10 is surrounded by a substantially rectangular wall 15, wherein the wall is sufficiently tall to prevent dice and other objects from departing the playing surface 15, yet short enough to allow players to readily participate in wagering and rolling the dice. Preferably, the upper surface 14 is covered with a felt material or the like, which prevents the dice which, are thrown onto the surface 14, from sliding, causing them instead to roll. To play the present game, players stand around the gaming table 10 in the areas designated for the players. The dealer(s) (not shown) stand in an area designated by the casinos for their use. Typically, the present game is operated, or "dealt", by only one or two dealers. The dealers typically sand next to each other, adjacent at dealer area 15*a* formed in the wall 15, as shown in FIG. 1. In comparison, craps typically requires between four and six dealers. Thus, the present gaming table provides tremendous operational savings over gaming tables of the prior art.

A pair of dice 16, 18 are provided for the play of the game. As explained in more detail hereinbelow, the two dice are conventional, six-sided dice having indicia on the faces thereof, representing various numbers and symbols. As indicated earlier the term dice used herein is understood to incorporate other random result generators such as electronic dice. The dice 16, 18 are combined when scoring, and are used to determine the success or failure of various wagers.

Playing surface 14 is preferably divided into a plurality of areas. As shown in FIG. 1, the surface 14 is imprinted with indicia that is symmetrical about the center of the table. When there is a sufficient number of players to warrant full operation of the game, the surface 14 is used as shown. Otherwise, the surface 14 may be divided vertically down its center, whereby only one half of the surface 14 is used to accommodate a small number of players. In either case, a center area 20 of the playing surface 14 is used by one of the dealers, called a "stickman" (not shown). The stickman places the thrown dice 16, 18 into the center area 20 after every roll of the dice.

Also located on the playing surface 14, positioned adjacent the center area 20, are a pair of betting areas 22, 24. The betting area 22 is substantially identical to the betting area 24, and accordingly, a detailed description thereof is not believed necessary. Each dealer is responsible for play in one of the betting areas 22, 24. The betting area 22 is comprised of a plurality of individual betting areas that offer players a plurality of betting opportunities described in more detail hereinbelow. For example, a first individual betting area 26 is positioned adjacent to the center area 20 and at the top side of the surface 14 as depicted in FIG. 1. A second individual betting area 28 is positioned adjacent and just below the first betting area 26. A third individual betting area 30 is positioned adjacent and juts below the second individual betting area 28. Finally, a fourth and fifth individual betting areas 32, 34 are positioned adjacent and just below the third betting area 30.

In the presently preferred embodiment, prior to the start of the game the one or more players stand near the board 12 and adjacent to the substantially rectangular wall 15. One of the players is handed the pair of dice 16, 18 which are used as a random result selector, whereby the success or failure of wagers is determined by the random result obtained by the selector. It will be appreciated by those skilled in the gaming art that the random result selector may be implemented using any random number generator capable of generating the combination results indicated on the table surface 14. For example, in the preferred embodiment, the random result selector is implemented with the pair of dice 16, 18.

Alternatively, the random result selector may be electronically calculated using a computer-generated random number. In another alternative, the random results may be obtained using electronic dice, a roulette-type wheel, or the like. However, the pair of physical dice 16, 18, are preferred because it is well known that players enjoy participating directly in determining the outcome of their wagers.

Referring now to FIG. 2, the play of the present game, using the gaming board 12, and the dice 16, 18, will now be described in more detail. The game begins when one of the dealers makes a call for bets. Once wagers have been placed on the surface 14, the dice 16, 18 are pushed, using a stick (not shown in the figures), to the first player to the dealer's right. The player given the dice, referred to as the "shooter", begins the game by placing a wager in one or several of the plurality of the individual betting areas 26, 28, 30, 32, 34 located in either of the betting areas 22, 24. For example, the shooter may choose to wager that the next roll of the dice will result in a total of "17" (e.g., one die lands with the number "11" facing upwards, and the other die lands having the number "6" facing upwards). In this case, the shooter may place money, casino chips, or similar token, in the fourth individual betting area 32. Alternatively, the shooter may place his wager in the appropriate square positioned within the second individual betting area 28. These individual betting areas, and their related odds and payoffs, are explained in more detail hereinbelow.

While the shooter is placing a valid wager on the playing surface 14, all of the other players at the gaming table 10 may also place their wagers on the playing surface 14 in a similar fashion. Once the other players have completed placing their wagers, the shooter is then permitted to roll the pair of dice 16, 18. Depending upon the outcome of the roll (i.e., which faces of the dice, representing numbers, are shown face up on the playing surface 14 after the roll), various wagers will win, and other wagers will lose. The preferred embodiment of the pair of dice 16, 18 used in the present invention will be described in more detail hereinbelow. However, similar to the use of dice in board games of the prior art, the pair of dice 16, 18 employed by the present invention are combined to determine the result of any particular roll. For example, one die may show an "up" t face bearing indicia representing the number "2", while the other die may show an "up" face bearing indicia representing the number "11". By combining the result of each die, i.e., by adding "2" with "11", the result of the roll is "13". Thus, if any of the players or the shooter placed a wager on the result "13", that wager would be successful and would be paid at the odds indicated on the surface 14. Odds calculations and pay-offs are described in more detail hereinbelow.

Again, as discussed previously, it will be apparent to one skilled in the gaming art that the "winning" result may be calculated using a device other than the random outcome of thrown dice. Dice are, again, preferred because players are known to enjoy handling dice and thereby more fully participate in determining the success or failure of their wagers.

Whether the random result selector used to practice the invention is implemented with the preferred dice or with some other device or mechanism, it is important that the selector be capable of providing only results corresponding to the plurality of betting areas indicating on playing surface 14. That is, the random result selector should not be capable of providing results that do not correspond to at least one betting area indicated on surface 14. Moreover, the random result selector must also be capable of providing every result corresponding to a betting area, albeit with differing frequency and correspondingly differing odds.

In one preferred embodiment, after rolling the dice, the shooter must relinquish control of the dice to the next player. Typically, the next player is the player to the shooter's right. However, the next player selected may alternatively be the player to the shooter's immediate left. Thus, each player gets the opportunity to roll the dice on a rotating basis. A player need not wait an indefinite amount of time to have an opportunity to roll the dice. Consequently, player participation is encouraged and emphasized by the present games Alternatively, the casino may choose to allow a shooter to keep rolling the dice until he or she loses their wager. Although this will cause the dice to be passed between players more slowly, this alternative may be preferred by players who wish to wait for a "hot" shooter, i.e. a shooter who systematically places successful wagers.

In either case, a shooter rolls the dice to determine the outcome of the wagers placed on the surface 14. The stickman calls out the result of the roll, and moves the dice, using a "stick", to the center area 20. At this point, all losing wagers are collected and all winning wagers are paid by the dealers. When all the winning wagers are paid, the dealer then calls for bets and the dice are passed to the next player. In one embodiment, players must call their wagers to the dealers before the wager is placed in the requested betting area. Alternatively, players may place wagers directly onto the surface 14, however, wagers may be directly placed only within the fourth and fifth individual betting areas 32, 34.

In the preferred embodiment, one die is an "even" die, and one die is an "odd" die. For example, preferably die 16 has five faces bearing five numbers, all of which are "even"; and die 18 has five faces bearing five numbers, all of which are "odd". In the preferred embodiment, the die 16 has five faces bearing the numbers "2", "6", "10", "14", and "16". The die 18 preferably has five faces corresponding to the following five numbers: "3", "7", "11", "15", and "19". Both pair of dice 16, 18 also have a sixth face bearing an indicia or logo and correspond to a numeric value of zero. In the preferred embodiment, the dice 16, 18 are combined to determine the result of a roll. For example, if after the dice 16, 18 are rolled, the die 16 has a top face bearing the number "2", and the die 18 has a top face bearing the number "3", the result of the roll is "5".

Having briefly described the play of the game 10 and the preferred pair of dice 16, 18, the various betting opportunities available to the players are now described in detail. In the preferred embodiment, the playing surface 14 offers players a total of 25 different betting opportunities. Players may simultaneously wager on any or all of the betting opportunities offered. The betting opportunities have varying degrees of risk, odds of success, and payoffs. Every wager is referred to as a "one roll" wager. That is, there are no betting opportunities which are valid for multiple rolls of the dice. The success or failure of all wagers are therefore determined after every roll.

Referring to FIG. 2, the fourth and the fifth individual betting areas 32, 34 are referred to as "line bets", which correspond to the well known "field bets" in craps. In the preferred embodiment, the fourth and fifth individual betting areas 32', 34' positioned so that players standing at the ends of the table 10 may also easily place their line bets. These line bets are treated identically to the line bets placed in the "original" fourth and fifth individual areas 32, 34. The fourth individual betting area 32 is referred to as the "line A" betting opportunity, and the fifth individual betting area 34 is referred to as the "line B" betting opportunity. As described above, these line bets are the only "self-service" bets available in the game; i.e., while all other bets must be called to and place by the dealers, these bets may be made directly by the players. Therefore, to place a line bet, players may simply place chips or the like in either of the line A or the line B betting areas 32 (or 32'), 34 (or 34'). The line A wager includes all results of the random result selector, in the preferred embodiment the pair of dice 16, 18, which total either "5," "9," "13," or "17". Therefore, if a wager is placed in the fourth individual betting area 32, corresponding to a line A bet, it will be successful if either a "5", "9", "13", or "17" is rolled. All other combinations will lose. The payoff, or return for the wager, is preferably indicated in a payoff area 36 positioned below and adjacent the fourth and the fifth individual betting areas 32, 34. As shown in FIG. 2, the line bets 32, 34 pay off at 2–1 odds. In other words, for every one dollar wagered, two dollars are returned to the player if the wager is successful. The line B wager, indicated in the fifth individual betting area 34, includes the results totaling either "25", "29", "33", or "37". Therefore, if a wager is placed in the fifth individual betting area 34, corresponding to a line B bet, it will be successful if either a "25", "29", "33", or "37" is rolled. All other combinations will lose. The line B payoff is 2–1; identical to the line A payoff.

As shown in FIG. 2, in the fourth and the fifth individual betting areas 32, 34, both the line bets "push on twenty-one". This banner indicates that neither of the line bets win if a "21" is rolled. However, the line bets do not lose either. Rather, a "push", or tie is the result. The money wagered in the fourth and the fifth individual betting area 32, 34 may either be removed by the player or left on the playing surface 14 for the next roll. These are the only "pushes", or tying bets in the game.

As shown in FIG. 2, within the third individual betting area 30 are a first five betting squares 38, 40, 42, 44, 46. The second individual betting area 28 similarly contains five betting squares 48, 50, 52, 54, 56. As shown in FIG. 2, the ten betting squares comprise two fields: a result of indicator field 58 and a payoff indicator field 60. The result indicator field 58 preferably comprises a large, bold-faced integer number (or combination symbol), which represents the dice roll required to win a wager placed in the selected betting square. The payoff indicator field 60 preferably comprises smaller-faced text that indicates the payoff odds if the selected or bet result is successful. For example, the betting square 38 has the result indicator 58 that indicates that the combination "25" must be rolled for a wager placed in the betting square 38 to be successful. If a "25" is rolled, the wager placed in the square 38 is pad off at a rate of seven-to-one, as dictated by the payoff indicator field 60 contained in the betting square 38 are only successful if a roll totaling "25" occurs. All other rolls lose. There are no "pushes" or ties for these wagers.

The remaining sequences of the first five betting squares 40, 42, 44, 46 similarly correspond to dice rolls of "29", "33", "21", and null symbol+null symbol, respectively. The payoffs are indicated in the payoff indicator fields 60. For example, as shown in FIG. 1, a "29" is paid off at a ten-to-one rate; a "33" is paid off at a rate of sixteen-to-one; a "21" is paid off at a rate of five-to-one; and a combination of two null symbols are paid off at a rate of thirty-three to one. Wagers placed in the betting square 46 are only successful if both the dies 16, 18, produce a top face embossed with the null symbol indicia. Any other dice roll combination will lose.

The second individual betting area 28 similarly contains the second five betting squares 48, 50, 52, 54, 56 which correspond to dice roll results of "17", "13", "9", "37" and "5", respectively. The payoffs are indicated in the payoff indicator fields 60 and are similar to the payoffs indicated above with reference to the first five betting squares 38-46. As shown in FIG. 2, a "17" is paid off at a seven-to-one rate. A "13" is paid off at a ten-to-one rate; a "9" is paid off at a rate of sixteen-to-one; a "37" is paid off at a rate of thirty-three-to-one; and finally, a "5" is paid off at a rate of thirty-three-to-one. As described above, only rolls corresponding to the number in the selected result indicator fields 58 will win, all other combinations will lose.

Referring again to FIG. 2, the first individual betting area 26 contains thirteen betting squares, which correspond to thirteen additional betting opportunities. The first individual betting area 26 is referred to as the "null symbol & number" area. To be successful when placing wagers within the first individual betting area 26, one die (e.g., the die 16) must result in a number (e.g. "2"), and the other die (e.g., the die 18) must result in the null symbol. If two null symbols result, all wagers placed within the first individual betting area 26 will lose. Similarly, if both of the dies 16, 18, result in a number (and therefore no null symbol result), all wagers placed within the first individual betting area 26 will lose. The only successful dice roll combination result, when wagering on the first individual betting area 26, is a number result for one die and a null symbol result for the other die.

More specifically, as shown in FIG. 2, the first individual betting area 26 has thirteen betting squares 62, 64, 66, 68,

70, 72, 74, 76, 78, 80, 82, 84, 86. The thirteen betting squares 68–86 each have a different bold-faced result number printed within them to allow players to wager on different dice roll combinations of a null and a selected result number. As briefly discussed above, the thirteen betting squares 68–86 are used when a player wishes to wager upon a dice roll combination that results in one die having a null symbol on its upper face, and the other die having the result number shown in the selected betting square on its upper face. For example, if a player wagers on the betting square identified by reference numeral 68, the only successful dice roll combinations are a null symbol result for die 16, and a "19" result for die 18 (or vice-versa). All other dice combinations result in losses for all wagers placed in this betting square. A player may similarly wager on the betting square identified by reference numeral 86. In that case, the only successful dice roll combination for that wager is a null symbol result for die 18, and a "2" result for die 16 (or vice-versa). Again, all other dice combinations result in loses for all wagers placed in the betting square. The remaining betting squares 70–84 function similarly. These wagers are on the other eight possible null symbol and result number combinations.

As shown in FIG. 2, a banner 88 is positioned above and adjacent to the thirteen betting squares 62–86. The banner 88 indicates the payoff associated with a successful wager on any one of ten of the thirteen betting squares, identified by reference numerals 68–86. As indicated by the banner 88, in the preferred embodiment a successful wager on any of these ten betting squares 68–86 results in a very high payoff of thirty-three to one. As one skilled in the art will appreciate, the payoff may be varied according to the advantage desired by the casino.

As can be seen in FIG. 2, the betting square identified by reference numeral 62 includes the description "low and high" in bold print, followed by the payoff of "2 to 1". This wager, referred to as the "easy roll line" wager, is successful for all dice rolls having combinations of a null symbol and any result number. In other words, a wager placed upon this betting square will be successful for any "null & number" wagers, or all wagers placed in the first individual betting area 26.

For example, if the die 16 results in a null symbol, and the die 18 results in a "7", wagers placed in the betting square identified by reference numeral 62 will be successful. As indicated in this betting square, this successful wager is paid off at a rate of two-to-one. Similarly, if the die 16 results in a "10" and the die 18 results in a null, wagers placed in the betting square identified by reference numeral 62 are successful and are paid off at two-to-one odds. However, if neither the die 16 nor the die 18 produces a null result, all wagers on this betting square (reference number 62) lose. Similarly, if both dice 16, 18 produce a null symbol result, or "double null" result, all wagers in this betting square lose.

The betting squares identified by reference numerals 64 and 66 operate similarly to the betting square identified by numeral 62; however, these former betting squares, numbers 64 and 66, each cover half the possible "null symbol & number" combinations covered by the betting square identified by reference numeral 62. Not unexpectedly, the payoff for a successful wager on either of these squares (numbers 64 and 66) is twice that of the payoff for a successful wager on the betting square identified by numeral 62. As indicated in the betting square identified by numeral 64 by the words "HIGH NUMBERS", this betting square covers all five possible dice roll combinations of a null plus a "high" number (i.e., "11", "14", "15", "18", or "19") result. In contrast, as indicated in the betting square identified by reference numeral 66 by the words "LOW NUMBERS", this latter betting square covers all five possible dice roll combinations of a null and a "low" number (i.e., "2", "3", "6", "7", or "10") result. These betting squares (reference numbers 64 and 66) also indicate that the payoff in this embodiment is four-to-one.

One skilled in the are will appreciate that variations may be made to both the payoffs indicated and the number of betting opportunities available to the players. For example, the first individual betting area 26 may be modified to allow for more "null & number" wagers. More combinations may be added simply by using a different random result selector, by changing the number of dice, or by changing the number of faces per dice. For example, five or six more "null & number" combinations may be added simply by using another six-sided die with the original pair of dice 16, 18. Naturally, the design of the playing surface 14 would need to be correspondingly modified. However, the embodiment described is preferred because it offers experienced players a sufficient number of betting opportunities to keep their interest without overwhelming and confusing casual players. In addition, by keeping the number of betting options to a relatively small number (25 in the preferred embodiment), the game may be easily and efficiently operated by one or two dealers.

Referring now to FIG. 3, the plurality of faces of a first die 100 for use with the surface 14 (FIG. 1) is shown. Similar in shape to an ordinary die (a cube having six faces), the die differs from an ordinary die by providing, in a preferred embodiment, a group of one or two-digit numbers indicated on five of its six faces. As shown in FIG. 3, a sixth face 102 has any symbol or text 104, but denotes a null or zero numeric value. When the first die 100 is rolled, the face of the die 100 that is uppermost when the die comes to rest, indicates the number or the symbol used to determine successful wagers.

The pair of dice 16, 18 illustrated in FIG. 4 together constitute a random result selector suitable for use with the surface 14 shown in FIG. 1 and discussed hereinabove. Both of the dice 16, 18 preferably have six faces; five faces containing different numbers, and a sixth face containing a symbol which indicates a null result. As shown in FIG. 4, the first die 16 preferably has five faces bearing five numbers, all of which are even; and the second die 18 has five faces bearing five numbers, all of which are odd. More specifically, as is shown in FIG. 4 the first die 16 has five faces identified by reference numerals 106–114, bearing the numbers "2", "46", "10", "14", and "18", respectively. A sixth face (reference numeral 116) of the first die 16 bears the null symbol. The second die 18 has five faces identified by reference numerals 118–126, corresponding to the following five numbers: "3", "7", "11", "15", and "19". When the pair of dice 16, 18 are rolled, the two faces that are uppermost when the dice come to rest become the successful dice roll combination.

Thus, the present invention provides a simple, easy to play, inexpensive apparatus and method for playing a game or chance employing dice.

It is to be understood that the present invention is not limited to the embodiments described above, but encompasses any and all embodiments within the scope of the following claims.

What is claimed is:

1. A multiple player wagering game wherein each player places bets and wins or loses based on a single overall outcome comprising:

a horizontal playing surface;

tokens representing various monetary values at least one of which must be wagered by each player participating in the game;

a random result selector, operated by each player in turn, capable of generating at least two random results at each turn of play, such that a first random result corresponds to one of a first finite set of positive integer numbers and a zero and a second random result corresponds to one of a second finite set of positive integer numbers and a zero, wherein said first set of numbers and said second set of numbers are mutually exclusive so that no number that is a member of said first set appears in said second set, said overall outcome is determined by the numeric sum of all said random results, and some overall outcomes are more likely than others;

multiple betting areas on said playing surface corresponding to different overall outcome wherein each said betting area is large enough to contain said tokens; wherein each player places a wager on one or more of said overall outcomes by placing a token on one or more of said betting areas prior to the operation of said random result selector by one player and each player wins or loses his wager depending on whether the overall outcome matches or does not match the overall outcome corresponding to the betting area upon which the player has placed his token.

2. The game of claim 1 wherein said betting areas comprise;

individual betting spaces for every possible said single overall outcome, and field betting spaces corresponding to various unique groupings of more than one possible said single overall outcome; wherein each one of said individual and said field betting spaces have an outcome indicator displaying a selected one or group of said single overall outcomes and a payoff indicator displaying a payoff corresponding to a successful wager on the selected overall outcome and said payoff indicators are apportioned such that, on average, a slight net loss to the player will accrue but the player, having been made fully aware of the potential risk by observation of said outcome indicator, and made fully aware of the potential gain by observation of said payoff indicator is likely to play again.

3. The game of claim 1 wherein said random result selector comprises a first die having six faces, wherein five of the faces represent said first set of positive integer numbers and the remaining face represents a zero;

a second die having six faces, wherein five of the faces represent said second set of positive integer numbers and the remaining face represents a zero; so that said first random result is determined by the upper face of said first die, and said second random result is determined by the upper face of said second die.

4. The game of claim 3, wherein said first finite set of positive integer numbers includes only odd numbers and said second finite set of positive integer numbers includes only even numbers.

5. The game of claim 4, wherein said first finite set of positive integer numbers comprises the numbers 3, 7, 11, 15, and 19 and said second finite set of positive integer numbers comprises the numbers 2, 6, 10, 14, and 18.

6. The game defined in claim 3, wherein said remaining face of said first die and said remaining face of said second die, both representing a numeric zero, are inscribed with a fanciful indicia.

7. The game of claim 1, wherein said random result selector is an electronic random number generator.

8. A method of playing a game of chance, comprising the steps of:

providing a playing surface and a plurality of dice having six faces of which at least five faces have first indicia corresponding to numerical values indicated thereon;

limiting the faces of each one die to include five integral numerical values and one symbol unrelated to a numerical value;

limiting all the numerical values associated with each one die to one of even integral values and odd integral values;

arranging each numerical value associated with each one die to differ from other numerical values of that die by increments greater than one unit of numerical value;

wagering on a selected outcome of played dice by placing tokens on the playing surface;

placing the dice upon the playing surface and causing one face of each die to face upwardly;

determining the outcome of played dice from upwardly facing faces of the dice after only one play of the dice;

displaying second indicia on the playing surface corresponding to all possible outcomes;

displaying third indicia on the playing surface corresponding to a payoff relative to each unit of value wagered for each outcome, whereby each participant can readily determine the result with respect to success of the wager and the resultant payoff of each wager; and arranging the second indicia displayed on the playing surface proximate the third indicia displayed on the playing surface such that the payoff of each outcome is displayed proximate the outcome, whereby a bettor need observe only a limited area of the playing surface to determine an outcome and payoff therefor.

9. A method of playing a game of chance, comprising the steps of:

providing a playing surface and a plurality of dice having six faces of which at least five faces have first indicia corresponding to numerical values indicated thereon;

limiting all the numerical values associated with each one die to one of even integral values and odd integral values;

wagering on a selected outcome of played dice;

placing the dice upon the playing surface and causing one face of each die to face upwardly; and determining the outcome of played dice from upwardly facing faces of the dice after only one play of the dice.

10. A method of playing a game of chance, comprising the steps of:

providing a playing surface and a plurality of dice having six faces of which at least five faces have first indicia corresponding to numerical values indicated thereon;

arranging each numerical value associated with each one die to differ from other numerical values of that die by increments greater than one unit of numerical value;

wagering on a selected outcome of played dice;

placing the dice upon the playing surface and causing one face of each die to face upwardly; and determining the outcome of played dice from upwardly facing faces of the dice after only one play of the dice.

* * * * *